United States Patent [19]

Abell, Jr.

[11] 4,098,240

[45] Jul. 4, 1978

[54] VALVE GEAR AND LASH ADJUSTMENT MEANS FOR SAME

[75] Inventor: Roy F. Abell, Jr., Battle Creek, Mich.

[73] Assignee: Eaton Corporation, Cleveland, Ohio

[21] Appl. No.: 550,485

[22] Filed: Feb. 18, 1975

[51] Int. Cl.[2] ..... F01L 1/24

[52] U.S. Cl. ..... 123/90.55; 123/90.56; 123/90.43; 123/90.35

[58] Field of Search ..... 123/90.55, 90.56, 90.57, 123/90.58, 90.59, 90.35, 90.34, 90.36, 90.43, 90.46, 90.63

[56] References Cited

U.S. PATENT DOCUMENTS

| | | | |
|---|---|---|---|
| 2,870,757 | 1/1959 | Dayton | 123/90.55 |
| 3,153,404 | 10/1964 | Van Slooten | 123/90.35 |
| 3,502,058 | 3/1970 | Thompson | 123/90.43 |
| 3,587,539 | 6/1971 | Dadd | 123/90.43 |
| 3,799,129 | 3/1974 | Cornell | 123/90.43 |
| 3,805,753 | 4/1974 | Bergmann | 123/90.35 |
| 3,855,981 | 12/1974 | Loon | 123/90.34 |
| 3,875,908 | 4/1975 | Ayres | 123/90.43 |
| 3,913,538 | 10/1975 | Ableitner | 123/90.35 |
| 3,967,602 | 7/1976 | Brown | 123/90.56 |

*Primary Examiner*—Charles J. Myhre

*Assistant Examiner*—Jeffrey L. Yates

*Attorney, Agent, or Firm*—R. A. Johnston

[57] ABSTRACT

Valve gear of preferably cam-over-rocker type for an internal combustion engine including a hydraulic lash adjustment means and in which the rocker is pivoted at one end on a stationary hydraulic adjuster. The lash adjuster operates from oil received under pressure from a gallery provided in the engine lubricant supply system. In the preferred practice, body of the adjuster is stationary with respect to the engine, and has a movable plunger with a one-way check valve for admitting and retaining oil in a chamber between the adjuster body and the plunger. A portion of the plunger extends beyond the body and has a rounded end for pivotally engaging the rocker arm with a reservoir in the plunger communicating with a one-way valve admitting oil to the chamber. An outlet metering means includes an aperture for controlling oil flow to the rocker. The plunger passage provides open communication between the pivot connection and the one-way check valve. An inlet metering means including an annular metering land provides exclusive lubricant communication from an oil entry port in the body to the reservoir.

10 Claims, 2 Drawing Figures

VALVE GEAR AND LASH ADJUSTMENT MEANS FOR SAME

BACKGROUND OF THE INVENTION

In relatively small displacement multicylinder internal combustion engines of the type having overhead valve gear, for example, four-cylinder in-line engines, it is not uncommon for such engines to operate at high rotational speeds, for example, 4000–6000 r.p.m. during a large percentage of the normal duty cycle. In this high r.p.m. regime, the inertial forces of the valve gear can become critical with respect to the valve spring closing force. In order to reduce the inertial forces of the valve gear, it is desirable to eliminate the pushrod type valve gear and utilize a direct acting or cam-over-rocker arrangement. This arrangement eliminates the tappets and pushrods between the camshaft and the valve rocker arms. However, in designing valve gear for a cam-over-rocker arrangement where the cam lobes contact the rocker arms directly, the usual technique, employed in pushrod-type valve gear of providing lash adjustment in the tappet, is not available. Whereas, in the conventional pushrod-type valve gear, the lash adjustment is usually provided in the form of a combination tappet-hydraulic valve lifter between the pushrod and the camshaft. Where attempts have been made to utilize hydraulic lash adjusters for cam-over-rocker valve gear, it has been found that the most compact arrangement is to provide the lash adjustment at a stationary pivot about which one end of the valve rocker is pivoted. However, where the lash adjusters operate from the pressurized engine oil, the force obtained from the oil pressure acting on the end of the adjuster plunger is increased by the mechanical leverage of the rocker and applied to the cam lobe at the rocker contact surface. This additional force results in the need for greater valve spring forces at high r.p.m.

Furthermore it has been found that, upon starting of cold engines having the cam-over-rocker type valve gear with hydraulic lash adjusters supplied by the engine lubricant system, at high r.p.m. while the engine is cold, extremely high oil pressure conditions are experienced. For example, it has been determined that high r.p.m. operation of a cold engine has produced engine lubricant system pressures in the range of 85 to 130 p.s.i.; whereas, ordinary engine operating conditions produce only a maximum lubricant pressure of 65 p.s.i. at maximum r.p.m.

In engines of the type having cam-over-rocker valve gear and employing stationary hydraulic lash adjusters supplied from the engine lubricant system, this high oil pressure, in the range of 85 to 130 p.s.i. acting across the surface of the lash adjuster plunger, provides a sufficient axial force on the plunger to pivot the rocker arm about a fulcrum, located at the point of contact of the rocker arm with the cam lobe, with a force sufficient to overcome the closing force of the engine poppet valve spring. Thus, a situation occurs where, at high r.p.m. with a cold engine, the hydraulic lash adjusters hold the engine valves open, and this condition is sometimes referred to as pump-up. This condtion will generally persist until the engine reaches normal operating temperature where the oil pressure decreases to the normal operating range. This decrease in oil pressure decreases the force of the lash adjuster plunger on the rocker arm and permits the valve springs to properly close the valves during each cam event.

SUMMARY OF THE INVENTION

The present invention provides a solution to the above-described problem by providing a hydraulic lash adjuster for stationary use in engines having cam-over-rocker type valve gear and permits the hydraulic lash adjuster to be supplied with lubricant from the engine supply system, but eliminates the force of the engine lubricant pressure acting over the surface of the lash adjuster plunger and thus eliminates "pump-up" during high r.p.m. cold engine operation. The valve gear of the present invention includes a hydraulic lash adjuster having a one-way valve in the plunger for admitting oil to the cavity between the plunger and the lash adjuster body and has a reservoir in the plunger communicating with the one-way valve and also communicating with the pivot portion of the plunger which engages the pivoted end of the rocker arm fluidically in series through a secondary metering means to the atmosphere. The rocker arm includes an aperture therethrough for venting to the atmosphere, lubricant supplied to the pivot through the secondary metering means. The lash adjuster of the present valve gear includes a lubricant entry port in the body for receiving lubricant from the engine supply system. A primary metering passage is provided in the lash adjuster for providing exclusive communication of the lubricant from the entry port to the plunger reservoir and includes primary fluid metering means for metering all the lubricant flowing to the plunger reservoir. The primary metering means of the lash adjuster of the present invention includes an annular metering land provided between the cooperating surfaces of the plunger and the bore in the lash adjuster body; whereas the secondary tandem metering means to the rocker pivot surface utilizes a restrictive orifice.

The present invention thus provides a solution to the above-described problem by venting through a secondary tandem metering means to the atmosphere the oil reservoir in the lash adjuster plunger such that there is only negligible effective oil pressure acting on the bottom of the plunger to apply a force to the rocker arm. The lash adjuster in the valve gear of the present invention receives oil from the engine lubricant supply and meters all of the lubricant flow to the plunger reservoir to provide lower pressure in the reservoir yet prevent undesirable loss of pressure in the engine supply.

DETAILED DESCRIPTION OF THE DRAWINGS

Figure 1:
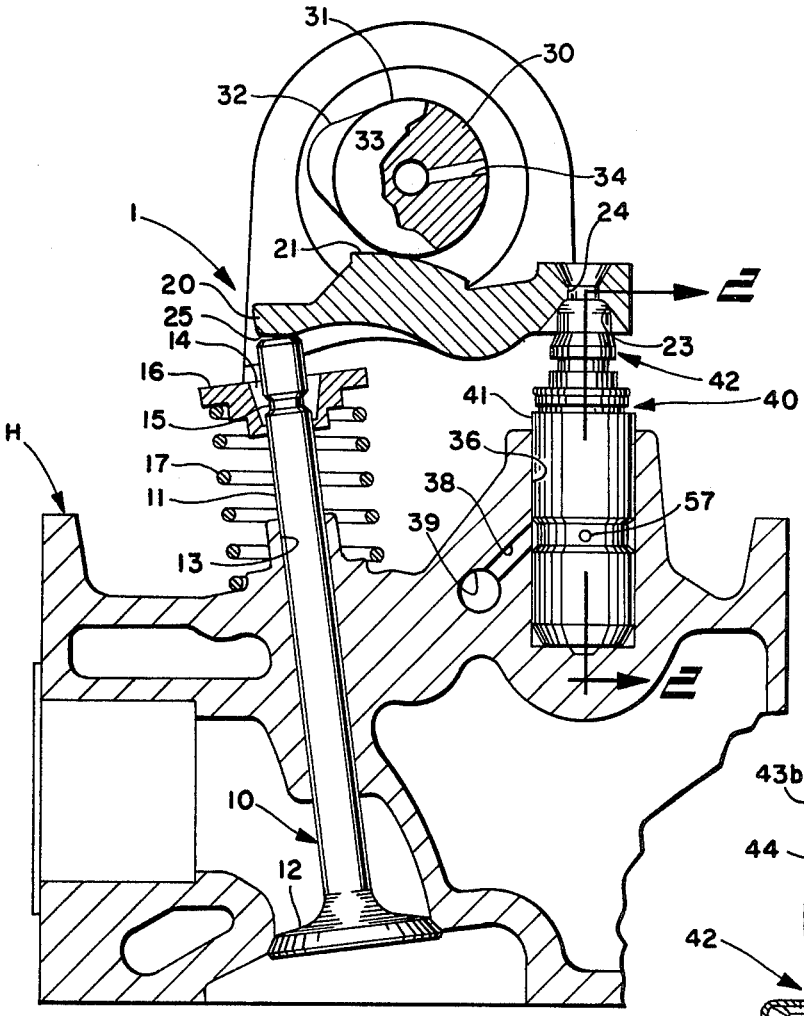
Figure 2:
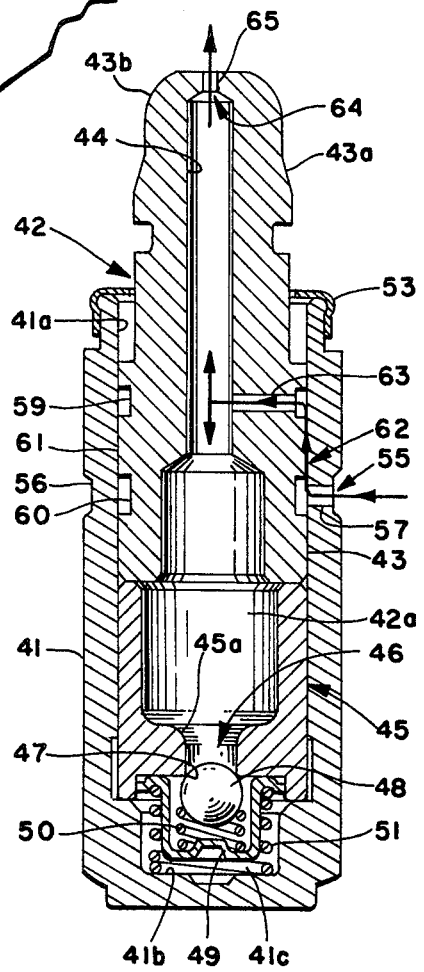

FIG. 1 is a transverse cross section through the cylinder head and camshaft of an overhead valve cam-over-rocker engine employing the valve gear of the present invention; and FIG. 2 is a section view taken along section indicating lines 2—2 of FIG. 1 and shows details of the stationary hydraulic lash adjuster.

DETAILED DESCRIPTION

Referring now to FIG. 1, the cylinder head H of an engine is shown in cross section with the overhead valve gear 1 for a single valve for communicating with the combustion chamber. The valve gear includes a poppet valve 10 having a stem portion 11 and a head portion 12 with the stem received in a valve guide 13 provided in the engine cylinder head H. The stem of the valve has a groove 15 formed therein in which is engaged a peripherally split keeper 14 for retaining thereon a spring washer 16 which provides a register for the valve compression spring 17.

An overhead rocker arm 20 is provided with a cam follower pad 21 provided on one side intermediate the ends thereof and has a contact pad 25 provided on one end of the side opposite the cam follower, for contacting the end of the valve stem. The opposite end of the rocker arm has a pivot recess 23 formed therein on the same side of the rocker arm as the valve stem pad 25 with a vent means, preferably in the form of an aperture 24, or oil hole, provided therethrough to communicate with a recess 23 from the opposite, or cam follower side of the rocker.

The end of the rocker arm having the pivot recess 23 formed therein is pivotally connected to a stationary pivot means in the form of a hydraulic lash adjuster 40. The engine camshaft 30 is disposed over the rocker and is mounted in bearings (not shown) attached to the engine cylinder head H in the usual manner. The camshaft has a plurality of lobes 32 each having a base circle portion 31 and the camshaft has a central oil gallery 33 in the form of a longitudinal bore therethrough. Each cam lobe has a radial oil port 34 communicating with the oil gallery 33 and extending radially outwardly to communicate with the base circle portion 31 of the cam lobe.

In operation, as the camshaft rotates, engine oil under pressure is supplied to the gallery 33 by a suitable rotary connection (not shown) communicating with the engine oil pump circuit. The oil is discharged radially outwardly from the oil ports 34 for providing lubrication of the cam lobe as it contacts the pad 21 of the rocker arm.

It will be readily apparent that, during the majority of each revolution of the camshaft, the oil discharged from the radial port 34 is discharged freely outwardly into the space surrounding the camshaft. It will thus be apparent to those skilled in the art that a suitable cover housing (not shown) will be required to retain the free discharged oil and return the oil to the engine sump.

Referring again to FIG. 1, a suitable blind bore 36 is provided in the engine cylinder head H for receiving therein the lash adjuster 40. The bore 36 has communicating therewith a suitable oil port 38 which port also communicates with an oil gallery 39 provided in the cylinder head of the engine. The oil gallery 39 is connected by suitable passages (not shown) to the engine oil pressure supply system and thus supplies engine oil under pressure to the hydraulic lash adjuster 40.

Referring now to FIG. 2, the stationary lash adjuster 40 is shown as having a body 41 preferably of cylindrical configuration with a bore **41*a* having a blind end 41*b* formed therein and with a plunger means 42 slidably received in the bore in close fitting relationship. The plunger is shown in the preferred form as formed of two pieces, an upper section 43 and a lower section 45, but it will be understood that the plunger means 42 may be made of one piece, if desired. The plunger is preferably made in two sections to permit enlargement of an oil passage therethrough in the region intermediate the ends of the plunger to form a fluid reservoir 42*a*. The upper section 43 of the plunger has an exterior portion 43*a* extending outwardly from the body 41 with the end of the plunger having a rounded tip 43*b*, preferably of spherical radius provided thereon for pivotally engaging the recess 23 in the rocker arm. The remainder of the upper section 43 is slidably received in the bore 41*a* in a closely fitting relationship. An oil passage 44 is provided longitudinally through the upper portion 43*a* of the plunger and extends the full length of the section 43 and communicates with pivot surface 43*b*. The passage 44 may, if desired, have a greater transverse dimension in the portion of the section 43 received in the bore, than the transverse dimension of the passage 44 in the exterior portion 43*a* in order to provide portions of reservoir 42*a***.

The lower section 45 abuts the upper section 43. The lower section of the plunger 45 also has a passage **45*a* provided therein which extends longitudinally therethrough. The passage 45*a*, if desired, may be enlarged in the region of abutment to provide portions of oil reservoir 42*a*. The end of the lower section 45 of the plunger means 42 forms, in cooperation with the end 41*b* of the blind bore 41*a*, a chamber 41*c* for retaining oil to maintain the plunger position for lash adjustment. A check valve 46 is provided in the end of the passage 45*a* of the lower section 45 of the plunger means so as to permit one-way flow of oil from the passage 45*a* through the end of the lower section 45 to the chamber 41*b*. The passages 44 and 45*a*** each preferably have a minimum transverse dimension equal to approximately one-third the transverse dimension of the plunger.

The check valve 46 preferably has a valve seat 47 formed at the juncture of the passage **45*a* with the end of the lower section 45 of the plunger means and the valve 46 has a movable member 48, preferably a check ball received therein. The member 46 is movable from a closed position contacting the valve seat 47 to an open position spaced from the valve seat 47. A cage 49 is received over the check ball and serves to retain the ball therein. A bias spring 50 is provided within the case to urge the check ball 48 to a closed position in contact with the valve seat 47. A plunger bias spring 51 is provided in the chamber 41*c* to register against the end of the lower portion 45 of the plunger means to urge the plunger in a direction away from the blind end 41*d*, of a bore 41*a*. An annular plunger retainer 53 is provided over the upper end of the body 41 with the exterior portion 43*a* of the upper plunger section 43 received therethrough, and the retainer 53 serves to retain the plunger means in the body against the bias force of spring 51**, when no load is present on the plunger means.

An oil entry port means 55 is provided on the exterior of the body 41. The port means includes a collector groove 56 and an oil entry aperture 57 communicating the collector groove 56 with the bore **41*a* in the body 41**.

The plunger means 42 has a pair of axially spaced grooves 59 and 60 disposed about the outer diameter thereof. The grooves 59 and 60 thus define, in co-operation with the bore **41*a*, a primary metering means 62 which includes an axial section of the outer diameter of the plunger means 42 which section forms a metering land 61. It will be apparent to those skilled in the art that collector grooves 59 and 60 are so located on the plunger means 42 such that, during the movement of the plunger means between its predetermined limits of lash adjustment the lower collector groove 60 will, at all times, receive oil from the entry port 55. The upper collector groove 59 has a passage means in the form of a cross hole 63 provided therein which cross hole communicates the upper collector groove 59 with the interior passage 44 in the plunger means. Thus, oil entering the port means 55 passes through the primary metering means 62, along the metering land 61 to the upper collector groove 59, then through cross hole 63 to the oil reservoir in the interior bore 44, 45***a* forming the reservoir 42*a* in the plunger means. The path of the metered oil is shown in FIG. 2 by the heavy black line with arrow heads indicating the direction of metered flow.

The arrangement of the distributor groove 58 in the body bore and the co-operating collector grooves 59 and 60 in the plunger means as shown in the embodiment of FIG. 2 provides a metering land having a preferable constant length not dependent upon the position of the plunger means 42 in the bore 41*a* of the adjuster body. This arrangement thus provides a constant length metering land as is known in the art, see, for example, U.S. Pat. No. 3,448,730 to Roy F. Abell, Jr. In the present practice of the invention plunger movements in the amount of 0.150 to 0.200 inches are permitted for lash adjustment and for which movement the metering land is maintained constant.

It will be apparent to those having ordinary skill in the art, that the adjacent abutting surfaces of the upper plunger section 43 and lower plunger section 45 must be designed so as to effectively provide a seal and prevent leakage of oil therethrough, thereby preventing an alternate by-pass, or shunt, flow of lubricant other than through the primary metering means having land 61.

In order to provide sufficient lubricant fluid flow across the check valve at high r.p.m. and to prevent consequent malfunction of the lash adjustment, it has been found necessary to maintain the fluid pressure reservoir 42*a* at pressures slightly above atmospheric. The present invention provides this pressure control by secondarily metering fluid flow from the reservoir 42*a*, through passage 44 in the upper plunger section, as it leaves passage 44, by a secondary metering means 64, preferably in the form of a restricting orifice 65. The presently preferred lash adjusting means 40 of the valve gear thus employs a primary metering means 62 and secondary metering means 64 in tandem, or fluidically in series, with the fluid reservoir 42*a* and rocker pivot surface 43*b*. For proper metering, the primary and secondary metering means are chosen such that the pressure drop $\Delta P_{62}$ across the primary metering means 62 is greater than the pressure drop $\Delta P_{62}$ across the secondary metering means 64. In the present practice of the invention it has been found for cold oil starts with oil entering port means 55 at 100 p.s.i. (34.4 Kg/cm$^2$) and using a primary metering land of 0.100 inches (2.54 mm) length with about 0.0021 in. (0.050 mm) clearance for a 0.60 in. (15.2 mm) diameter plunger and restricting orifice 65 of 0.015 inches (0.32 mm) diameter gives a pressure of 10.5 p.s.i. in reservoir 42*a*.

Although the lash adjustment means of the present invention has been described as employed in a stationary lash adjuster for the cam-over-rocker type valve gear, it will be appreciated that the lash adjustment means may be employed also in a cam-following hydraulic tappet for use with the conventional cam-in-block type valve gear having pushrods with oil supplied up through the pushrods to the rocker arms. In this latter type of valve gear, a hydraulic tappet using the present lash adjustment means could readily be formed by simply shortening the upper plunger member 43 so as to not extend beyond the body 41, removing the rounded tip 43*b* and replacing same with a concave pushrod socket for receiving a pushrod. The secondary metering means 65 with restrictive orifice 64 would be retained and would then communicate fluid to the pushrod socket thus formed in such a tappet arrangement.

In operation, as the base circle portion of the cam rotates to a position in contact with the path 21 on the rocker arm, the spring 51 urges the plunger sections 43 and 45 away from the bore end 41*b* so that the rounded tip 43 moves the rocker to contact and urge the recess 23 in the rocker arm upward until the pad 21 is forced to contact a base circle portion of the cam. As the cam lobe 32 contacts the pad 21 of the rocker arm and asserts a force on the pivoted end of the rocker arm, both of the plunger sections 43, 45 are forced downward together as a unit in a manner tending to compress the oil trapped in chamber 41*c*. The check valve 46 prevents unwanted flow of oil from the chamber 41*c* and thus prevents further downward movement of the plunger sections, shortening of the adjuster and thus prevents further movement of the rocker pivot.

The valve gear, including its stationary hydraulic lash adjuster, of the present invention thus provides a novel and convenient technique for providing hydraulic lash adjustment to overhead valve gear of the cam-over-rocker type. The hydraulic lash adjuster of the present invention receives oil from an engine oil pressure gallery and all oil flow to the lash adjuster reservoir is metered through a primary annular metering land. The oil reservoir within the lash adjuster is in communication with the rocker pivot portion of the lash adjuster and oil flows from the reservoir through a secondary metering means which maintains the reservoir pressure slightly above atmospheric pressure to provide adequate fluid flow across the check valve for lash adjustment at high engine speeds.

Further modifications and variations will be apparent to those having ordinary skill in the art and the invention is limited only by the following claims.

What is claimed is:

1. Hydraulic lash adjusting means for valve gear of an internal combustion engine comprising:

(a) a body having a blind bore formed therein;

(b) plunger means slidably received in said body bore for defining, in cooperation with the blind end of said bore, a cavity, said plunger means including pivot means adapted to contact associated engine valve gear components, and, (i) means defining a fluid reservoir, and (ii) one-way valve means permitting fluid flow from said reservoir to said cavity;

(c) said body including port means adapted for receiving fluid under pressure therein;

(d) means defining a first fluid passage communicating with said port means and providing exclusively fluid communication therefrom with said reservoir, said passage defining means including a first fluid metering means defining a substantially constant length annular metering orifice between said plunger means and said body bore for continuously metering said fluid flow into said fluid reservoir, said annular metering orifice being effective for causing a substantial pressure drop thereacross;

(e) said plunger means including means defining second fluid passage and providing exclusive fluid communication from said reservoir means to said pivot means, said second passage defining means including second fluid metering means comprising a metering orifice, said metering orifice providing continuous fluid communication to said pivot being sized for maintaining said fluid pressure in said fluid reservoir above atmospheric pressure; and (f) means biasing said plunger means outwardly of said cavity.

2. The lash adjusting means defined in claim 1, wherein said first metering means includes a constant length annular metering land on said plunger means cooperating with said bore to define said annular metering orifice.

3. The lash adjusting means defined in claim 1, wherein, for any given fluid entry pressure and viscosity at said port means, said first and second metering means are arranged such that the pressure drop across said first metering means is greater than the pressure drop across said second metering means.

4. The lash adjusting means defined in claim 1, wherein said plunger means includes (a) an upper plunger member having portions thereof extending axially outwardly of said body bore, said portions defining said pivot means; said upper member having portions thereof defining said first fluid passage and portions thereof defining said second fluid passage; and (b) a lower plunger member including said one-way valve means, with said lower plunger member including portions thereof defining at least a part of said fluid reservoir.

5. The lash adjusting means defined in claim 4, wherein said upper plunger member has portions thereof defining at least part of said reservoir.

6. In valve gear for internal combustion engines of the type having overhead valves actuated by pivoted rocker members which operatively contact a rotating camshaft having a plurality of cam lobes each having a base circle portion, with the camshaft being disposed over the rockers, the improvement comprising:

(a) said rocker members each having an elongated configuration with one end thereof contacting the end of one of said valves with each of said rockers having a portion intermediate the ends thereof contacting a cam lobe;

(b) a plurality of stationary pivot means attached to said engine with the remaining end of each of said rocker members operatively connected to one of said pivot means;

(c) hydraulic lash adjustment means therein, with each of said lash adjustment means including said pivot means and port means adapted for receiving pressurized fluid from the engine lubricant supply, said hydraulic lash adjustment means including, (i) a body having a blind bore formed therein;

(ii) plunger means slidably received in said body bore for defining, in cooperation with the blind end of said bore, a cavity, said plunger means including said pivot means, said plunger means each including means defining a fluid reservoir and one-way valve means permitting fluid flow from said reservoir to said cavity, (iii) said body adapted for receiving fluid under pressure from said port means;

(iv) means defining a first fluid passage communicating with said port means and providing exclusively fluid communication therefrom with said reservoir, said passage defining means including a first fluid metering means defining a substantially constant length annular metering orifice between said plunger means and said body bore for continuously metering said fluid flow into said fluid reservoir, said annular metering orifice being effective for causing a substantial pressure drop thereacross;

(v) said plunger means including means defining second fluid passage and providing exclusive fluid communication from said reservoir means to said pivot means, said second passage defining means including second fluid metering means comprising a metering orifice, said metering orifice providing continuous fluid communication to said pivot being sized for maintaining said fluid pressure in said fluid reservoir above atmospheric pressure; and (vi) means biasing said plunger means outwardly of said cavity.

7. The valve gear defined in claim 6, wherein said first fluid metering means includes a constant length annular metering land on said plunger means cooperating with said bore to define said annular metering orifice.

8. The valve gear defined in claim 6, wherein said annular metering land has a constant length for all positions of said plunger means between predetermined limits.

9. The valve gear defined in claim 6, wherein said second metering means includes means defining a flow restricting orifice.

10. The valve gear defined in claim 6, wherein said first and second metering means are arranged such that, for any given fluid pressure and viscosity applied to said port means, the pressure drop across said first metering means is greater than the pressure drop across said second metering means.

* * * * *